United States Patent [19]

Fuchizawa et al.

[11] Patent Number: 4,908,295

[45] Date of Patent: Mar. 13, 1990

[54] PHOTOGRAPHIC SUPPORT

[75] Inventors: Tetsuro Fuchizawa; Kazuyuki Koike, both of Shizuoka, Japan

[73] Assignee: Fuji Photo Film Co., Ltd., Kanagawa, Japan

[21] Appl. No.: 301,764

[22] Filed: Jan. 26, 1989

[30] Foreign Application Priority Data

Jan. 26, 1988 [JP] Japan ..... 63-14896
Apr. 6, 1988 [JP] Japan ..... 63-84667

[51] Int. Cl.[4] ..... G03C 1/76

[52] U.S. Cl. ..... 430/272; 430/275; 430/495; 430/523; 430/524; 430/526; 430/950; 428/409; 428/463

[58] Field of Search ..... 430/272, 275, 495, 523, 430/524, 526, 950; 428/409, 463

[56] References Cited

U.S. PATENT DOCUMENTS 4,237,206 12/1980 Fujita ..... 430/950

FOREIGN PATENT DOCUMENTS 253390 1/1988 European Pat. Off. .
110445 6/1985 Japan .

*Primary Examiner*—Hoa Van Le
*Attorney, Agent, or Firm*—Sughrue, Mion, Zinn, Macpeak & Seas

[57] ABSTRACT

A photographic support having a secondary diffuse-reflective surface is disclosed, wherein a thin metal layer is provided on the matted surface of a substrate and the center plane average roughness, as determined by a three dimensional roughness measuring apparatus, of the thin metal layer is 0.1 to 1.2 μm.

2 Claims, No Drawings

PHOTOGRAPHIC SUPPORT

FIELD OF THE INVENTION

The present invention relates to a photographic support which provides excellent images. More particularly, it is concerned with a photographic support which is greatly improved in terms of luminance and saturation of the image, gradation reproducibility of the dark area, sharpness and so on. This photographic support is free from problems such as peeling-apart of the silver halide light-sensitive layer and formation of fog or spot as encountered during the developing process, and provides an image which has good reproducibility of properties such as hue and gradation and which is excellent in sharpness.

BACKGROUND OF THE INVENTION

As is well known, in comparison with conventionally known photographic supports, e.g., transparent plates or films of TAC, PET, polycarbonate and the like, paper, synthetic paper, baryta paper, polyolefin-laminated paper, films or plates containing white pigment, and metal plates such as an aluminum plate, the surface of which is subjected to anodization treatment, a photographic support having a metal reflective or secondary diffuse-reflective surface provides a photographic or recording medium which is excellent in terms of reproducibility of gradation, reproducibility of hue in color photography, sharpness of image, and so on. Such photographic supports are described, for example, in JP-A-61-210346 (the term "JP-A" as used herein means an "unexamined published Japanese patent application"), JP-A 63-118154, JP-A-63-24247, JP-A-6324251, and JP-A-63-24252.

In the support disclosed in JP-A-61-210346, the distance between the thin metal layer and the photographic emulsion is 30 μm or more because a thermoplastic resin layer and/or a transparent substrate is sandwiched therebetween. Further, white pigment is incorporated in the thermoplastic resin in order to decrease the directivity of reflected light from the metal deposited layer and increase the scattering of the reflected light. This support is sufficiently satisfactory in luminance, but is not necessarily sufficient in resolving power.

JP-A-63-118154, JP-A-63-24247, JP-A-63-24251, JP-A-63-24252 JP-A-63-104234 and Japanese Patent Application Nos. 61-168804 and 61-168805 disclose methods (first methods) to obtain the secondary diffuse-reflective layer, where metal foils such as of aluminum, silver, gold, copper, nickel, chromium and platinum, or alloys thereof are used and then converted into a secondary diffuse-reflective layer by pressing two sheets together at the same time, and employing a matted surface in the inside thereof, which is subjected to patterning at the time of extending, e.g., by sand blasting mechanically, such as by the use of a brush or spraying fine particles of an abrasive (e.g., a pumice stone powder), in a jet stream, or etching by the electrolytic method. They further disclose methods (second methods) in which a thin metal layer is formed by techniques such as vacuum deposition, sputtering, ion plating, electro deposition, and non-electrolytic plating, and then it is converted into a secondary diffuse-reflective surface by the method described in the first methods.

The metal foil to be used in the first methods, however, holds flexibility even after bonded to a base paper or a plastic film and thus difficulties are encountered in handling at the time of light exposure or development. In the second methods, the thin metal layer is first provided on a substrate and then is subjected to surface treatment to impart the secondary diffuse-reflective properties. Therefore, it is necessary to provide a thin metal layer having a sufficient thickness to withstand the surface treatment, which is not economical.

When a less noble metal than silver is used in the support for preparation of photographic or recording light-sensitive material using a silver halide photographic emulsion, fog or spots tend to be readily formed in the course of development. For this reason, as is known, an adhesive layer of thermoplastic resin is provided. However, during the development or drying after development, the film is readily peeled apart, and furthermore when a thermoplastic resin is used, it becomes difficult to form a layer having a thickness of 0.1 to 5 μm.

In addition, over the course of a long time from development, there is a danger of the mirror surface or secondary diffuse-reflective property being deteriorated, or the evenness of reflectivity being reduced.

SUMMARY OF THE INVENTION

An object of the present invention is to provide a photographic support which is free from the above defects and has secondary diffuse-reflectivity.

Another object of the present invention is to provide a photographic support which is good in terms of luminance and saturation of the image, gradation reproducibility of the dark area, and sharpness, and which is good in handling at the time of development and is economical.

Still another object of the present invention is to provide a photographic support which is free from problems such as peeling-apart of a light-sensitive layer in the course of development, or before and after development, and is good in preservation of image.

These objects are attained by using a photographic support in which a thin metal layer having secondary diffuse-reflectivity is provided on the matted surface of a substrate and further in which the matted form of the thin metal layer is such that the average roughness based on the central surface ($SR_a$) (center plane average roughness), as determined by the use Of a three dimensional roughness measuring apparatus, is 0.1 to 1.2 μm.

As the three dimensional roughness measuring apparatus, "MODEL SE-3AK" (produced by Kosaka Laboratory Ltd.) was used, and the average roughness based on the central surface (center plane average roughness) was measured at a wavelength of 2 to 250 μm. The "center plane average roughness (μm)" ($SR_a$) as used herein can be defined as described, for example, in *THREE DIMENSIONAL ROUGHNESS*, Analysis System SPA-11, published by Kosaka Laboratory Ltd., i.e., where X-axis and Y-axis crossing each other at right angles are put on the center plane Of the area $S_M$ extracted form a roughness curved surface with Z-axis crossing them at right angles through the center plane $SR_a$, is represented by the value given by the following formula in μm:

$$SR_a = \frac{1}{S_M} \int_0^{L_x} \int_0^{L_y} |f(x,y)| \, d_x d_y$$

where $S_M = L_x . L_Y$

By using 40 to 95% by weight of a copolymer comprising vinylidene chloride, vinyl chloride, vinyl acetate and maleic anhydride and 5 to 60% by weight of a polyurethane urea resin in preparing an adhesive layer for the photographic support, peeling-apart of a light-sensitive layer in the course of development or before and after development, and storage stability of image can be improved.

DETAILED DESCRIPTION OF THE INVENTION

The substrate to be used in the present invention can be chosen from known substrate materials for supports. Examples thereof are films of polyesters such as polyethylene terephthalate and polybutylene terephthalate, a cellulose triacetate film, a polystyrene film, films of polyolefins such as polyethylene and polypropylene films and a nylon film.

The surface of the substrate is matted by techniques such as incorporating a pigment, coating a pigment or mechanically processing. Pigments which can be used include silica, titanium dioxide, barium sulfate, calcium sulfate, barium carbonate, calcium carbonate, lithopone, alumina white, zinc oxide, antimony trioxide, and titanium phosphate. These can be used alone or as mixtures comprising two or more thereof. The particle diameter of the pigment is preferably 0.5 to 8 μm, more preferably 1 to 5 μm. The amount of the pigment added is preferably 1 to 10%, more preferably 1 to 5%. In dispersing the pigment in the resin, metal soap such as zinc stearate and aluminum stearate, and other surfactants can be used as the dispersing agent.

In matting by pigment coating, the aforementioned pigments can be used. As the binder, any of water soluble binders, water dispersed binders and nonaqueous binders can be used. The binder can be chosen appropriately from those described in Sogo Gijutsu Center ed., *Saishin Binder Gijutsu Binran.* As the water soluble binder, gelatin, PVA, casein and the like can be used. When these binders are used, it is desirable to use a hardener. As the water dispersed binder, butadiene copolymer latex, vinyl acetate resin emulsion, acryl emulsion, polyolefin-based emulsion and the like can be used. As the non-aqueous binder, polyester-, vinyl acetate-, thermoplastic elastomer-, polyurethane-, melamine-, urea-, alkyd-, acryl- and phenol-bassed binders can be used.

As a method of matting by mechanical treatment, a method in which sand blasting is carried out by spraying fine particles of an abrasive in a jet stream can be employed.

The thickness of the matted film is preferably from 15 to 30 μm.

A thin metal layer is provided on the above matted film, which can be used as such or after laminate to a substrate (hereinafter, referred as "substrate for lamination") such as a paper, plastic film, cloth as the photographic support.

The above adhesive method can be chosen appropriately from known lamination methods as described in Kako Gijutsu KenkYukai ed., *Shin Laminate Kako Binran.* Of these methods, so-call dry lamination or non-solvent-type dry lamination is preferably employed.

Dry lamination is a method in which an adhesive is coated on a plastic film and then dried and, thereafter, press bonded to substrate for lamination at about 100° C. As the adhesive, a solvent type vinyl resin, an acryl resin, a polyamide resin, an epoxy resin, a rubber resin, a urethane resin and the like is used in an amount of 2 to 15 g/m$^2$.

Non-solvent type dry lamination is a method in which a plastic film coated with a reaction curable adhesive such as a one-pack moisture curable urethane adhesive or a two-pack urethane adhesive, in an amount of 0.8 to 5.0 g/m$^2$, is adhered to a substrate for lamination, which is then allowed to stand to cure the adhesive and completely adhere the plastic film and the substrate for lamination.

The method of coating an adhesive can be chosen appropriately from known methods such as gravure roll coating, wire bar coating, doctor blade coating, reverse roll coating, dip coating, air knife coating, calender coating, kiss coating, squeeze coating and fountain coating.

The substrate for lamination includes those conventionally used as supports, e.g., a plastic film, paper, RC paper, synthetic paper, and a metal plate, or a plate of polymers or copolymers having excellent dimensional stability, such as polycarbonate, polystyrene, polyacrylate, polymethacrylate and PET. In the case of a disc-like recording medium as described in JP-A-63-104234, polycarbonate, polystyrene, a polyimide resin and ceramics each having excellent dimensional stability and physical strength are used.

In addition to the above substrates for lamination, substrates such as a coated paper, cloth and a polyolefin coated paper can be used.

As the coating solution for the coated paper, the same as the aforementioned film coating solution can be used.

As the base paper, those known as the photographic support can be used. Examples are paper of natural pulp, paper of synthetic pulp made from plastic materials such as polyethylene and polypropylene, and paper made from natural pulp and synthetic pulp.

It is necessary to improve the smoothness of the substrate for lamination because the smoothness of the photographic support is greatly influenced by the smoothness of the substrate for lamination. Thus, when a base paper of short fiber pulp is used as the substrate for lamination, it is preferred to use those smoothened by heat calendering and so forth.

Although the thickness of the substrate for lamination is not critical, it is usually 30 to 300 μm and preferably about 70 to 200 μm.

Metals which can be used in the formation of the thin metal layer in the present invention include metals made mainly of aluminum as described in JP-A-50-139720, and metals such as tellurium, molybdenum, polonium, cobalt, zinc, copper, nickel, iron, tin, vanadium, germanium, silver and silver emulsion, chromium, and titanium, or alloys thereof as described in JP-A-48-65927, JP-A-48-65928 and JP-A-50-2925. Of these, an aluminum thin film layer is most preferred as the thin metal layer to be used in the present invention.

The thin metal layer can be provided by known techniques such as the vacuum deposition method, the sputtering method, the ion plating method and the electro deposition method. The thin metal layer may be a singly layer or a multi layer comprising two or more layers.

In the formation of the thin metal layer, if inorganic oxides such as silicon monoxide, silicon dioxide, silicon oxide, aluminum oxide, magnesium oxide, tantalum oxide, boron silicon oxide (e.g., borosilicate) and titanium oxide are vacuum deposited in combination, oxidation of the thin metal layer can be prevented.

Prior to vacuum deposition on the matted film of the present invention, activation treatment, e.g., corona discharging treatment of the substrate and pretreatment, e.g., treatment using a primer can be applied in order to increase the adhesion between the substrate and the vacuum deposited film.

As resins to be used as the primer, there are solvent type, aqueous type and non-solvent type resins. Solvent type acryl-, cellulose-, vinyl chloride-, urethane- and polyester-based resins commonly used can be used. These may be of the one pack lacquer or of the two-pack reaction curable type. In addition, ultraviolet ray curable and electron beam curable resins of the non-solvent type can be used. In this case, the technology described in Primer treatment in Vacuum Deposition in *Convertech*, Jan. 1986, pp. 31 to 42 can be used.

The thickness of the thin metal is preferably within the range of 20 to 4,000 Å and particularly preferably within the range of 50 to 2,000 Å.

In connection with the roughness of the mat of the thin metal layer, average roughness based on the central surface (center plane average roughness) $SR_a$ as determined by the use of a three dimensional roughness measuring apparatus Model SE-3AK produced by Kosaka Laboratory Ltd., (wavelength: 2 to 250 μm) is preferably 0.1 to 1.2 μm and particularly preferably 0.3 to 1.0 μm. less than 0.1 μm, the image has luminance, but since it has strong directivity, it becomes dark depending on the angle of the eye. On the other hand, more than 1.2 μm, the sharpness is sufficient, but the essentially desired luminance is decreased.

The photographic material of the present invention is obtained by providing a silver halide emulsion layer mediated by an adhesive layer on the support. In preparation of the adhesive layer, an ionomer resin as described in JP-A-63-118154, a styrene-butadiene based resin as described in Japanese Patent Application No. 62-87637, and a silane coupling agent as described in Japanese Patent Application No. 62-87636 and vinylidene chloride can be used. Of these, it is preferred to use 40 to 95% by weight of a copolymer containing vinylidene chloride, vinyl chloride, vinyl acetate and maleic anhydride and 5 to 60% by weight of a polyurethane urea resin. The copolymer of vinylidene chloride, vinyl chloride, vinyl acetate and maleic anhydride is preferably a copolymer of (a) 5 to 60% by weight of vinylidene chloride, (b) 20 to 75% by weight of vinyl chloride, (c) 5 to 15% by weight of vinyl acetate, and (d) 0.1 to 5% by weight of maleic anhydride.

The polyurethane urea resin employed in the present invention is a polymer containing a large amount of urethane bond

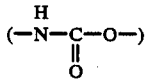

and ura bond

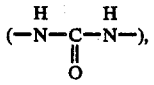

and means a resin obtained by reacting a polyvalent isocyanate or its prepolymer with a polyhydric hydroxy compound or a polar liquid.

Examples of the polyvalent isocyanate or polyvalent isocyanate prepolymer to be used in the present invention are diisocyanates such as m-phenylene diisocyanate, p-phenylene-diisocyanate, 2,6-tolylene didiisocyanate, diphenylmethane 4,4'-diisocyanate, 3,3'-dimethoxy-4,4'-biphenyl diisocyanate, 3,3'-dimethyldiphe.ylmethane 4,4'-diisocyanate, xylilene 1,4-diisocyanate, xylilene 1,3-diisocyanate, 4,4'-diphenylpropane diisocyanate, trimethylene diisocyanate, hexamethylene diisocyanate, propylene 1,2-diisocyanate, butylene 1,2-diisocyanate, ethylidene diisocyanate, cyclohexylene 1,2-diisocyanate, and cyclohexylene 1,4-diisocyanate; triisocyanates such as 4,4',4''-triphenylmethane triisocyanate, toluene 2,4,6-triisocyanate and polymethylene polyphenyl isocyanate; tetraisocyanates such as 4,4'-dimethyldiphenylmethane 2,2',5,5'-tetraisocyanate; and adducts of the above polyvalent isocyanates with compounds such as polyvalent amines, polyvalent carboxylic acids, polyvalent thiol, polyvalent hydroxyl compounds and epoxy compounds, containing at least two isocyanate groups in the molecule thereof.

Examples of the polyvalent hydroxy compounds are aliphatic or aromatic polyhydric alcohols, hydroxypolyester, hydroxypolyalkylene ether, and adducts of polyvalent amines and alkylene oxide. More specifically catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzene, 2,4-dihydroxyethylbenzene, 1,3-naphthalenediol, 1,5-naphthalenediol, 2,7-naphthalenediol, 2,3-naphthalenediol, o,o'-biphenol, p,p'-biphenol, 1,1'-bi-2-naphthol, bisphenol A, 2,2'-bis(4-hydroxyphenyl)butane, 2,2'-bis-(4-hydroxyphenyl)isopentane, 1,1'-bis(4-hydroxyphenyl)cyclopentane, 1,1'-bis(4-hydroxyphenyl)cyclohexane, 2,2'-bis(4-hydroxy-3-methylphenyl)propane, bis(2-hydroxyphenyl)methane, xylilenediol, ethylene glycol, 1,3-propylene glycol, 1,4-butylene glycol, 1,5-pentane diol, 1,6-heptane diol, 1,7-heptane diol, 1,8-octane diol, 1,1,1-trimethylolpropane, hexanetriol pentaerythritol, glycerine and sorbitol.

The hydroxypolyester is formed from, for example, polycarboxylic acid and polyhydric alcohol. Polycarboxylic acids which can be used in the preparation of the hydroxypolyester include malonic acid, succinic acid, glutaric acid, adipic acid, pymeric acid, maleic acid, isophthalic acid, terephthalic acid, and glucolic acid. As the polyhydric alcohol, the aforementioned can be used.

The hydroxypolyalkylene ether is, for example, a condensate of alkylene oxide and polyhydric alcohol. As the alkylene oxide, to be used in the preparation of the hydroxypolyalkylene ether, butylene oxide or amylene oxide can be used, and as the polyhydric alcohol, the aforementioned compounds can be used.

The alkylene oxide adduct of polyvalent amine means a compound obtained by substituting one or more of hydrogen atoms in the amino group of the polyvalent amine with alkylene oxide. Polyvalent amines which can be used in the preparation of the polyvalent amine/alkylene oxide adducts include aromatic polyvalent amines such as o-phenylenediamine, p-phenylenediamine and diaminonaphthalene, and aliphatic polyvalent amines such as ethylenediamine, 1,3-propylenediamine, diethylenetriamine and 1,6-hexamethylenediamine. As the alkylene oxide adduct, a number of compounds such as ethylene oxide, propylene oxide and butylene oxide can be used.

The most typical as a polar liquid is water. In addition, ethylene glycol, glycerine, butyl alcohol, octyl alcohol and the like can be used.

The weight ratio of the copolymer of vinylidene chloride, vinyl chloride, vinyl acetate and maleic anhydride to the polyurethane-urea resin is 95/5 to 40/60 and preferably 90/10 to 50/50. If the proportion of the polyurethane-urea resin is less than 5% by weight, the adhesion to the secondary diffuse-reflective surface is not sufficiently high. On the other hand, if it is more than 60% by weight, the adhesion between the adhesive layer and the silver halide emulsion layer is not sufficiently high.

After the adhesive layer is coated and then dried, in order to increase the adhesion to the silver halide emulsion, it is effective to apply pre-treatment such as corona discharging, glow discharging and flame treatment. Prior to the coating of the silver halide emulsion, a subbing layer of gelatin may be provided.

From the viewpoint of an adhesiveness between the secondary diffuse-reflective layer and the silver halide light-sensitive layer, color reproducibility, a gradation of the color images and cost, it is preferably for the adhesive layer to be uniformly coated in a very thin thickness ranging between 0.1 to 10 μm, preferably 1 to 5 μm, in contact with the secondary diffuse-reflective layer on the surface of the support substrate.

As a dilution solvent for the adhesive layer of the present invention, ketones such as MEK and acetone, chlorinated compounds such as trichlene, esters such as ethyl acetate and butyl acetate, and aromatic organic solvents such as triol can be used. Particularly preferred is ethyl acetate.

Although the adhesive layer of the present invention is distinguishable in that it is provided on the top surface of the thin metal layer having secondary diffuse-reflectivity, it can be coated by the methods described in JP-A-51-114120, JP-A-54-94025, and JP-A-49-11118. More specifically, it can be coated by techniques such as dip coating, air knife coating, curtain coating, roller coating, doctor coating, wire bar coating, slide coating, gravure coating and reverse coating.

The support of the present invention can be widely used as a photographic reflective support. A silver halide emulsion layer for black-and-white photographic paper is provided on the support, and further a protective layer can be provided thereon. Similarly, two or more light-sensitive silver halide emulsion layers containing different color couplers and having different spectral sensitivities for the usual color photographic paper are provided to produce a color photographic paper light-sensitive material. A color reversal light-sensitive material and a direct positive color photographic paper, or a direct positive color copy material using the light fogging method can be produced. A print light-sensitive material of the SDB system can be produced by providing red-sensitive, green-sensitive and blue-sensitive silver halide emulsion layers containing silver halide particles having different spectral sensitivities and dyes to be used in the silver dye bleaching (SDB) method on the support. The support of the present invention can be applied to a reflection type disc plate, a disc film and a recording material using silver halide. More specifically, the support of the present invention can be used in light-sensitive materials as described, for example, in JP-A-63-24251 and JP-A-63-24252 and Japanese Patent Application Nos. 61-168804, 61-168805, 61-249873, 61-259794 and 61-275572.

The support of the present invention can be used in the production of a material in which a color removal dye is diffused and transferred to form a dye image, by providing a mordanting layer thereon. The support of the present invention can be used as a material in which a silver image of the silver diffusion transfer type is formed, by providing a subbing layer containing a center of physical development thereon. On the support of the present invention can be provided an adsorption layer (ADL) containing development inhibitors or desilvering inhibiting substances as described in JP-B-59-3737 (the term "JP-B" as used herein means an "examined Japanese patent publication") and JP-A-50-65230, e.g., iodobromide ion, bromide ion, heterocyclic compounds having a mercapto group, and heterocyclic compounds capable of forming iminosilver.

The photographic support of the present invention can be applied to heat developable light-sensitive material and/or dye fixing material (image-receiving material) as described, for example, in U.S. Pat. No. 4,500,626, JP-A-60-133449, JP-A-59-218443, and Japanese Patent Application No. 60-79709.

The support of the present invention in which a thin metal layer is provided on the matted substrate and which is coated with a photographic emulsion is good in luminance and saturation of image, reproducing power of the dark area and sharpness, and further is good in handling properties at the time of development.

By providing the adhesive layer of the present invention on the metal surface having secondary diffuse-reflectivity, peeling-apart of the silver halide light-sensitive layer and formation of fog, spots and the like during the developing process can be avoided, and further there can be obtained an image which is good reproducibility in hue, gradation and so on and is excellent in sharpness.

The present invention is described in greater detail with reference to the following examples although it is not intended to be limited thereto. Unless otherwise specified, all parts, percents and ratios are by weight.

EXAMPLE 1

As a substrate, a 25 μm thick polyethylene terephthalate film filled with 2% by weight of silica having an average particle diameter of 3 μm was placed in a vacuum deposition apparatus, and vacuum deposition was carried out in a vacuum of $10^{-5}$ Torr to form an aluminum deposited film having a thickness of 600 Å on the surface of the substrate.

On the surface of the aluminum film layer, an adhesive (adhesive layer) having the composition shown below was diluted with ethyl acetate and coated in a dry amount of 5 g/m2 and dried at 100° C for 2 minutes in an oven.

| Adhesive (Adhesive layer) | | |
|---|---|---|
| Vinylidene chloride | 40 parts | 70 parts |
| Vinyl chloride | 50 | |
| Vinyl acetate | 9 | |
| Maleic anhydride | 1 | |
| Adduct of torylenediisocianate and trimethylol propane | | 30 parts |

Wood pulp consisting of 20 parts of LBSP and 80 parts of LBKP was beated to a Canadian freeness of 300 cc by the use of a disc refinery. To the wood pulp were added 1.0 part of sodium stearate, 0.5 part of anion polyacrylamide, 1.5 part of aluminum sulfate, 0.5 part of polyamidepolyamine epichlorohydrin, and 0.5 part of alkylketene dimer, all being absolute dry weight ratios, and paper having a base weight of 160 g/m$^2$ was produced by the use of a fourdrinier wire paper machine.

The density was controlled to 1.0 g/cm$^3$ by the use of a machine calendar. On this base paper was formed a polyethylene resin layer by extrusion coating low density polyethylene (MFR (Melt Flow Ratio) =7 g/10 min; density: 0.923g/cc) in a thickness of 30 μm after carrying corona discharging treatment to the base paper. Then the other surface (back surface) of the substrate was subjected to corona discharging treatment and then high density polyethylene (MFR 8 g/10 min; density: 0.950 g/cc) was extrusion coated thereon to form a 30 μm thick polyethylene resin layer. Thus, a two surface polyethylene laminated paper was obtained.

On the back side of the above aluminum deposited film (opposite side to the deposited side) was coated a two-pack type polyurethane adhesive in a dry thickness of 3 g/m$^2$ and then dried at 100° C. for 2 minutes. Adhesive:

| Adhesive | |
|---|---|
| Polypond AY-651A (produced by Sanyo Chemical Industries Co., Ltd.) | 100 parts |
| Polypond AY-651C (produced by Sanyo Chemical Industries Co., Ltd.) | 15 parts |

This coated surface and the low density polyethylene surface of the two surface polyethylene laminated paper were brought into contact with each other and heat pressed at 80° C. under a pressure of 20 kg/cm.

EXAMPLE 2

On a 30 μm thick polypropylene film as a substrate which had been matted with a matted cooling roll at the formation of film was formed an aluminum deposited film in the same manner as in Example 1.

A bonded paper was produced using the same adhesives and base paper as used in Example 1 and according to the same polyethylene lamination method and dry lamination method as used in Example 1.

EXAMPLE 3

By using a mat roll as a cooling roll in extrusion coating of low density polyethylene in the same composition as in the two surface polyethylene laminated paper shown in Example 1, a polyethylene layer having a matted surface was formed.

After application of corona treatment to the above surface, a solvent type urethane resin as a primer was coated, and an aluminum deposited film was formed thereon by the same method as in Example 1.

COMPARATIVE EXAMPLE 1

A 10 μm thick soft aluminum foil was obtained according to Example 1 of JP-A-63-118154. Dibutyl titanate was coated on the metal mirror side of the aluminum foil and then dried. Thereafter, it was bonded to the same base paper as in Example 1 by the use of low density polyethylene melted at 300° C. Then, the same adhesive as used in Example 1 was coated on the matted surface of the aluminum foil.

COMPARATIVE EXAMPLE 2

A 25 μm thick polyethylene terephthalate film having an $SR_a2$ of 0.050 μm which was matted by means of a sand blast method was placed in a vacuum deposition apparatus, and vacuum deposition was carried out in a vacuum of $10^{-5}$ Torr to form an aluminum deposited film having a thickness of 600 Å on the surface of the substrate.

A bonded paper was produced using the same adhesives and base paper as used in Example 1 and according to the same polyethylene lamination method and dry lamination method as used in Example 1.

COMPARATIVE EXAMPLE 3

On the matted surface of the polyethylene laminated paper produced in Example 1 was coated a pigment layer having the composition shown below in a dry thickness of 5 g/m$^2$, and an aluminum deposited film was formed thereon in the same manner as above.

Silica (10 μm) : 80 parts

SBR : 20 parts

On the supports obtained in Examples 1 to 3 and Comparative Examples 1 to 3 was coated a silver halide emulsion according to Example 4 of JP-A-63-24247 to produce color photographic papers.

The silver halide emulsion (1) to be used in the present invention was prepared as shown below.

| | |
|---|---|
| (Solution 1) | |
| $H_2O$ | 1,000 cc |
| NaCl | 5.5 g |
| Gelatin | 32 g |
| (Solution 2) | |
| Sulfuric acid (1 N) | 24 cc |
| (Solution 3) | |
| Silver halide solvent (1% (v/v)) shown below | 3 cc |

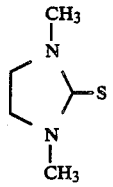

| | |
|---|---|
| (Solution 4) | |
| KBr | 15.66 g |
| NaCl | 3.30 g |
| $H_2O$ added to make 200 cc | |
| (Solution 5) | |
| $AgNO_3$ | 32 g |
| $H_2O$ added to make 200 cc | |
| (Solution 6) | |
| KBr | 62.72 g |
| NaCl | 13.22 g |
| $H_2IrCl_6$ (0.001% (w/v)) | 4.54 cc |
| $H_2O$ added to make 600 cc | |
| (Solution 7) | |
| $AgNO_3$ | 128 g |
| $H_2O$ added to make 600 cc | |

Solution 1 was heated to 56° C., and Solutions 2 and 3 were added thereto. Then, Solutions 4 and 5 were added at the same time over 30 minutes. After 10 minutes, Solutions 6 and 7 were added at the same time over 20 minutes. Five minutes after the addition, the temperature was lowered to perform de-silvering. Water and ispersed gelatin were added and the pH was adjusted to 6.2 to obtain a monodisperse cubic silver chlorobromide emulsion having an average particle size of 0.45 μm, a variation coefficient (value obtained by dividing the standard deviation by the average particle size: s/d) of 0.08, and containing 70 mol % of silver bromide. By adding sodium thiosulfate to the emulsion, the emulsion was subjected to the optimum chemical sensitization.

Silver halide emulsions (2), (3) and (4) having different silver chloride contents were prepared in the same manner as above except that the amounts of KBr and NaCl in Solutions 4 and 6, and the time of addition of Solutions 4 and 5 were changed as shown in Table 1.

TABLE 1

| Emulsion | Solution 4 KBr (g) | Solution 4 NaCl (g) | Solution 6 KBr (g) | Solution 6 NaCl (g) | Time of Addition of Solutions 4 & 5 (min.) |
|---|---|---|---|---|---|
| (2) | 6.71 | 7.70 | 26.88 | 30.84 | 12 |
| (3) | 3.36 | 9.35 | 13.44 | 37.44 | 10 |
| (4) | 0.22 | 10.89 | 0.90 | 43.61 | 8 |

The average particle size, diviation coefficient and halogen composition of the silver halide emulsions (1) to (4) are shown in Table 2

TABLE 2

| Emulsion | Average Particle Size (μm) | Deviation Coefficient (s/d) | Halogen Composition Br (%) | Halogen Composition Cl (%) |
|---|---|---|---|---|
| (1) | 0.45 | 0.08 | 70 | 30 |
| (2) | 0.45 | 0.07 | 30 | 70 |
| (3) | 0.45 | 0.07 | 15 | 85 |
| (4) | 0.45 | 0.08 | 1 | 99 |

On each support were provided the first to eventh layers shown in Table 3 to form a color light-sensitive material.

First Layer:

Silver halide emulsion (4) was spectrally sensitized by adding $7.0\times10^{4}$ mol of a blue-sensitive sensitizing dye (a) per mol of Ag. In addition, predetermined amounts of a yellow coupler (d) and a color dye stabilizer (e) were dissolved or dispersed in a solvent (f), and added. The resulting mixture was coated to form the first layer.

Third Layer:

Silver halide emulsion (3) was spectrally sensitized by adding $4.0\times10^{-4}$ mol of a green-sensitive sensitizing dye (b) per mol of Ag. In addition, predetermined amounts of a magenta coupler (h) and a color dye stabilizer (i) were dissolved or dispersed in a solvent (j), and added. The resulting mixture was coated to form the third layer.

Fifth Layer:

Silver halide emulsion (2) was spectrally sensitized by adding $1.0\times10^{-4}$ mol of a red-sensitive sensitizing dye (c) per mol of Ag. In addition, predetermined amounts of a cyan coupler (n) and a color image stabilizer (o) were dissolved or dispersed in a solvent (f) and added. The resulting mixture was coated to form the fifth layer.

Similarly, the coating solutions for the second, fourth, sixth and seventh layers were prepared.

On the adhesive layer of the support were coated the first to seventh layers by conventional methods in the amounts shown in Table 3 to prepare materials of Examples 1 to 3 and Comparative Examples 1 to 3.

The above material was subjected to gradation exposure for sensitometry through a blue, green and red-three color separation filter, or to image exposure for extended on print through a negative film by the use of a 2854° K. light source.

Then the material was subjected to color development, bleach-fixation and rinsing to obtain a photographic image.

| | | | |
|---|---|---|---|
| Development | Formulation A | 35° C. | 45 seconds |
| Bleach-Fixation | Formulation A | 35° C. | 45 seconds |
| Rinsing | Formulation A | 28–35° C. | 90 seconds |

Formulation A of Color Developer

| | |
|---|---|
| Water | 800 cc |
| Diethylenetriamine pentaacetate | 1.0 g |
| Sodium sulfite | 0.2 g |
| N,N—Diethylhydroxylamine | 4.2 g |
| Potassium bromide | 0.6 g |
| Sodium chloride | 1.5 g |
| Triethanolamine | 8.0 g |
| Potassium carbonate | 30 g |
| N—Ethyl-N—(β-methanesulfonamidoethylamino)-3-methyl-4-aminoaniline sulfate | 4.5 g |
| 4,4'-Diaminostylbene fluorescent whitener (Whitex 4 produced by Sumitomo Chemical Co., Ltd.) | 2.0 g |
| Water to make | 1000 cc |
| Adjusted to pH by adding KOH | 10.25 |

Formulation A of Bleach-Fixer

| | |
|---|---|
| Ammonium thiosulfate (54 wt %) | 150 cc |
| $Na_2SO_3$ | 15 g |
| $NH_4$ [Fe(III)(EDTA)] | 55 g |
| EDTA.2Na | 4 g |
| Glacial acetic acid | 8.61 g |
| Water to make | 1000 cc |
| pH | 5.4 |

Formulation A of Rinsing Solution

| | |
|---|---|
| EDTA.2Na.$2H_2O$ | 0.4 g |
| Water to make | 1000 cc |
| pH | 5.4 |

TABLE 3

| Layer | Main Ingredients | Amount |
|---|---|---|
| Seventh Layer (Protective Layer) | Gelatin | 0.17 g/cm$^2$ |
| | Acryl modified copolymer of polyvinyl alcohol (degree of modification: 17%) | |
| Sixth Layer (Ultraviolet Absorbing Layer) | Gelatin | 0.54 g/m$^2$ |
| | Ultraviolet absorber (k) | 0.21 g/m$^2$ |
| | Solvent (m) | 0.09 cc/m$^2$ |
| Fifth Layer (Red-Sensitive Layer) | Silver halide emulsion (2) | 0.22 g/m$^2$ (silver) |
| | Gelatin | 0.90 g/m$^2$ |
| | Cyan coupler (n) | 0.36 g/m$^2$ |
| | Color image stabilizer (o) | 0.17 g/m$^2$ |
| | Solvent (f) | 0.22 cc/m$^2$ |
| | Red-sensitive sensitizing dye (c) | |
| Fourth Layer (Ultraviolet Absorbing Layer) | Gelatin | 1.60 g/m$^2$ |
| | Ultraviolet absorber (k) | 0.62 g/m$^2$ |
| | Color mixing inhibitor (l) | 0.05 g/m$^2$ |
| | Solvent (m) | 0.26 cc/m$^2$ |
| Third Layer (Green Sensitive Layer) | Silver halide emulsion (3) | 0.15 g/m$^2$ (silver) |
| | Gelatin | 1.80 g/m$^2$ |
| | Magenta coupler (h) | 0.38 g/m$^2$ |
| | Color image stabilizer (i) | 0.16 g/m$^2$ |
| | Solvent (j) | 0.38 cc/m$^2$ |
| | Green-sensitive sensitizing dye (b) | |
| Second Layer (Color Mixing Inhibiting Layer) | Gelatin | 0.99 g/m$^2$ |
| | Color mixing inhibitor (g) | 0.08 g/m$^2$ |

TABLE 3-continued

| Layer | Main Ingredients | Amount |
|---|---|---|
| First Layer (Blue-Sensitive Layer) | Silver halide emulsion (4) | 0.26 g/m$^2$ (silver) |
| | Gelatin | 1.83 g/m$^2$ |
| | Yellow coupler (d) | 0.91 g/m$^2$ |
| | Color image stabilizer (e) | 0.19 g/m$^2$ |
| | Solvent (f) | 0.36 cc/m$^2$ |
| | Blue-sensitive sensitizing dye (a) | |

(a) Blue-sensitive sensitizing dye

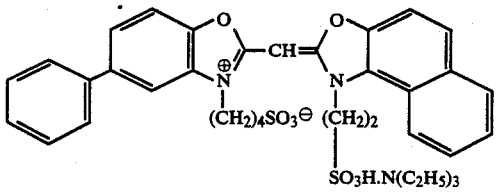

(b) Green-sensitive sensitizing dye

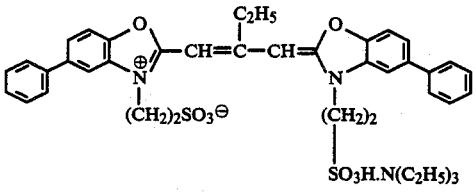

(c) Red-sensitive sensitizing dye

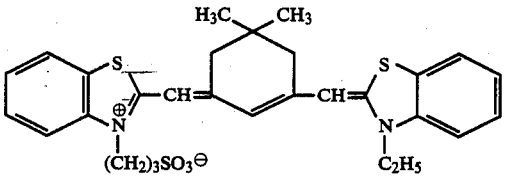

(d) Yellow coupler

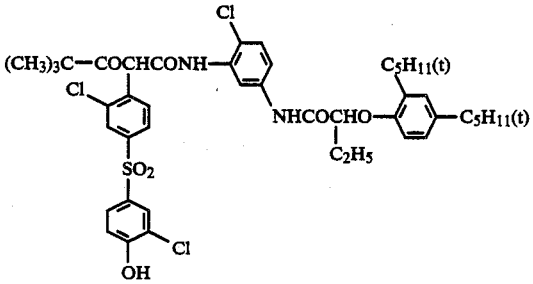

(e) Color image stabilizer

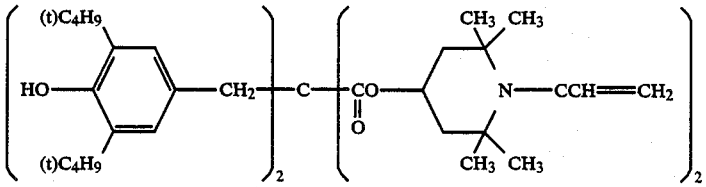

(f) Solvent

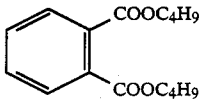

(g) Color mixing inhibitor

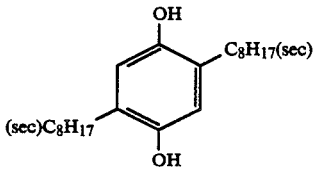

(h) Magenta coupler

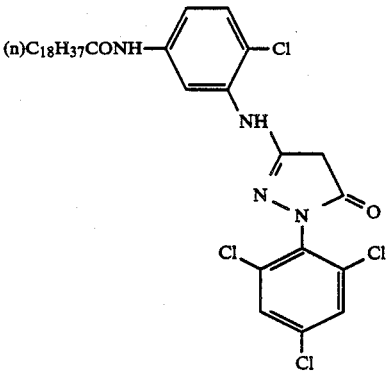

(i) Color image stabilizer

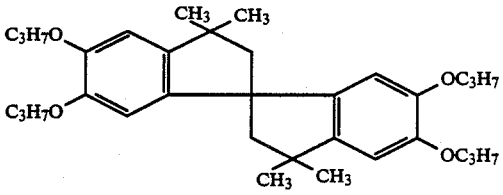

(j) Solvent

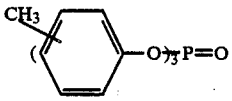

(k) Infrared ray absorber
1:5:3 Mixture (molar ratio) of

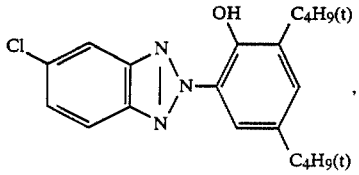

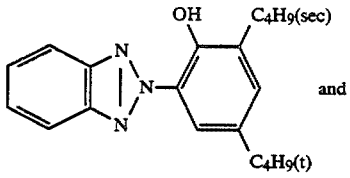

and

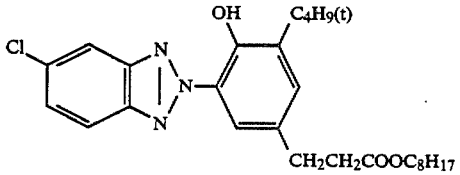

(1) Color mixing inhibitor

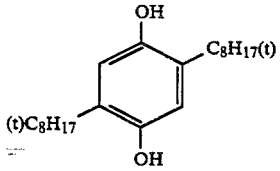

(m) Solvent $(isoC_9H_{19}O)_3P{=}O$ (n) Cyan coupler

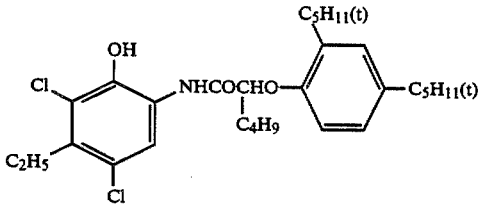

(o) Color image stabilizer
1:3:3 Mixture (molar ratio) of

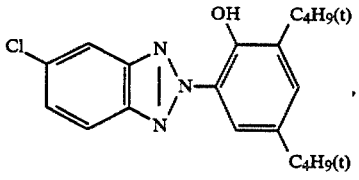

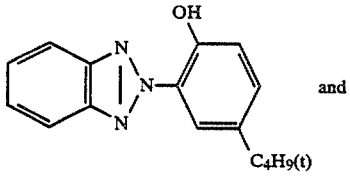

and

-continued

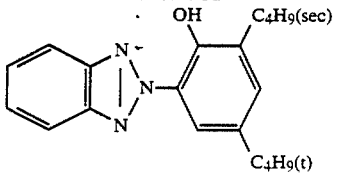

The color print was measured for luminance, directivity of reflected light, and sharpness with the eye. The results are shown in Table 4 along with handling properties and $SR_a$ value.

TABLE 4

| Evaluation Test | Example 1 | Example 2 | Example 3 | Comparative Example 1 | Comparative Example 2 | Comparative Example 3 |
|---|---|---|---|---|---|---|
| $SR_a$* of Support | 0.40 | 0.68 | 1.05 | 0.180 | 0.06 | 1.50 |
| Print | | | | | | |
| Luminance | ◎ | ◎ | ◎ | ○–◎ | ◎ | Δ |
| Directivity | ◎ | ◎ | ◎ | Δ | X | ○–◎ |
| Sharpness | ◎ | ◎ | ◎ | ○ | Δ | ○ |
| Handling Properties | ○ | ○ | ○ | X | ○ | ○ |

*$SR_a$: Average roughness of central surface as determined at a wavelength of 2 to 250 μm.
◎: Excellent
○: Good
Δ: Somewhat Bad
X: Bad As apparent from Table 4, the support of the present invention is good in luminance of the color print, directivity sharpness and handling properties, and thus is excellent as a whole.

EXAMPLES 4 to 9

A two surface polyethylene laminated paper was produced in the same manner as in Example 1 except that the adhesive layer shown in Table 5 was used in place of the adhesive layer of Example 1 (Example 5 was the same as Example 1.).

On the back surface (opposite surface relative to the deposited surface) of the aluminum deposited film as described above was coated a polyurethane two-pack type adhesive having the composition shown below in a dry thickness of 3 g/m², which was dried at 100° C. for 2 minutes.

| Composition of Adhesive | |
|---|---|
| Polypond AQ-651A (produced by Sanyo Chemical Industries, Ltd.) | 100 parts |
| Polypond AY-651C (produced by Sanyo Chemical Industries, Ltd.) | 15 parts |

The coated surface and the low density polyethylene surface of the two surface polyethylene laminated paper were brought into contact with each and heat pressed at 80° C. under a pressure of 20 kg/cm.

TABLE 5

| Adhesive Layer | Example 4 | 5 | 6 | 7 | 8 | 9 |
|---|---|---|---|---|---|---|
| Vinylidene Chloride/Vinyl Chloride/Vinyl Acetate/ Maleic Anhydride Copolymer (40/50/9/1 by weight) | 90 | 70 | 50 | 70 | 70 | 60 |
| Tolylene Diisocyanate/ Trimethylol Propane Adduct | 10 | 30 | 50 | — | — | 20 |
| Hexamethylene Diiso- | — | — | — | — | 30 | 20 |

TABLE 5-continued

| Adhesive Layer | Example 4 | 5 | 6 | 7 | 8 | 9 |
|---|---|---|---|---|---|---|
| cyanate/Trimethylol-propane Adduct | | | | | | |
| Xylilene Diiso-cyanate/Trimethylol-propane Adduct | — | — | — | — | 30 | 20 |

On the above support was coated a silver halide emulsion in the same manner as n Example 1 to obtain a color photographic paper.

The photographic paper thus obtained was evaluated by the following adhesion testing methods.

Adhesion Testing Method:

(1) Adhesion test after drying of silver halide emulsion:

A polyester adhesive tape (Nitto Myler Tape No. 31) was bonded to the emulsion surface after drying the photographic emulsion and peeled apart instantly.

(2) Adhesion test in the wet condition:

On the emulsion layer of the sample after development, fixation and water rinsing were formed scratches by an iron pencil in a checked form in the wet condition, which was then rubbed ten times with a rubber under a load of 3 kg.

(3)Adhesion test after development processing and drying:

On the emulsion layer of the sample after development, fixation, water rinsing and drying were formed scratches by an iron pencil in a checked form. Nitto Myler Tape No. 31 was bonded thereto and allowed to stand for 24 hours under conditions of 25° C. and 55% RH and then peeled apart instantly.

The rating was as follow:

A: The emulsion layer was not peeled apart at all.

B: The emulsion layer was slightly peeled apart

C: The emulsion layer was peeled apart, but practically usable.

D: The emulsion layer was peeled apart to an extent unsuitable for practical use. The results of the adhesion test are shown in Table 6.

TABLE 6

| Test Condition | Example 4 | 5 | 6 | 7 | 8 | 9 |
|---|---|---|---|---|---|---|
| At Drying before Processing | A | A | A | B | B | A |
| At Wetting in Processing | A | A | B | C | B | B |
| At drying after Processing | B | A | A | B | B | A |

As apparent from the results of Table 6, adhesion of the silver halide emulsion layer is increased by providing the adhesive layer of the present invention.

While the invention has been described in detail and with reference to specific embodiments thereof, it will be apparent to one skilled in the art that various changes and modifications can be made therein without departing from the spirit and scope thereof.

What is claimed is:

1. A photographic support having a secondary diffuse-reflective surface wherein a thin metal layer having a secondary diffuse-reflectivity is provided on the matted surface of a substrate, and an adhesive layer is provided on the thin metal layer, and the center plane average roughness, as determined by a three dimensional roughness measuring apparatus, of the thin metal layer is 0.1 to 1.2 μm.

2. The photographic support as claimed in claim 1, wherein the adhesive layer comprises (1) 40 to 95% by weight of a copolymer of vinylidene chloride, vinyl chloride, vinyl acetate and maleic anhydride and (2) 5 to 60% by weight of a polyurethane urea resin.

* * * * *